US006764240B2

(12) United States Patent
Eddington

(10) Patent No.: US 6,764,240 B2
(45) Date of Patent: Jul. 20, 2004

(54) UNIVERSAL REFILL MECHANISM AND METHOD

(75) Inventor: Ryan S. Eddington, Dallas City, IL (US)

(73) Assignee: BIC Corporation, Mildford, CT (US)

( * ) Notice: Subject to any disclaimer, the term of this patent is extended or adjusted under 35 U.S.C. 154(b) by 8 days.

(21) Appl. No.: 10/196,218

(22) Filed: Jul. 17, 2002

(65) Prior Publication Data

US 2004/0013462 A1 Jan. 22, 2004

(51) Int. Cl.[7] ..... B43K 7/02
(52) U.S. Cl. ..... 401/210
(58) Field of Search ..... 401/103, 107, 401/108, 110–115, 210, 222, 292

(56) References Cited

U.S. PATENT DOCUMENTS

| | | | | | |
|---|---|---|---|---|---|
| 2,803,219 | A | | 8/1957 | Stoeberl | 120/42.4 |
| 2,829,623 | A | | 4/1958 | Barnes | 120/42.4 |
| 2,860,602 | A | | 11/1958 | Fisher | 120/42.4 |
| 2,865,333 | A | | 12/1958 | Hechtle | 120/42.03 |
| 2,914,027 | A | | 11/1959 | Sears | 120/42.4 |
| 2,990,205 | A | | 6/1961 | Weisser | 287/119 |
| 3,039,437 | A | | 6/1962 | Walker | 120/42.4 |
| 3,064,624 | A | | 11/1962 | Hechtle | 120/42.03 |
| 3,095,859 | A | | 7/1963 | Levy | 120/42.03 |
| 3,119,377 | A | | 1/1964 | Johnmann | 120/42.4 |
| 3,137,276 | A | | 6/1964 | Weisser | 120/42.03 |
| 3,180,320 | A | | 4/1965 | Groft | 120/45.4 |
| 3,205,863 | A | * | 9/1965 | Rhoades | 401/111 |
| 3,418,057 | A | | 12/1968 | Shea | 401/209 |
| 3,462,232 | A | | 8/1969 | Longarzo | 401/209 |
| 3,464,774 | A | | 9/1969 | Vetter | 401/110 |
| 3,531,213 | A | | 9/1970 | Sams | 401/209 |
| 3,544,227 | A | | 12/1970 | Green | 401/52 |
| 3,652,173 | A | | 3/1972 | Miller et al. | 401/110 |
| 3,654,377 | A | | 4/1972 | Bross | 401/110 |
| 3,679,317 | A | | 7/1972 | Larson | 401/109 |
| 3,941,490 | A | | 3/1976 | Anton | 401/110 |
| 4,381,158 | A | | 4/1983 | Garganese | 401/111 |
| 4,515,046 | A | | 5/1985 | Johnson | 81/436 |
| 5,052,838 | A | | 10/1991 | Tucker | 401/65 |
| 5,207,524 | A | | 5/1993 | Arnold III | 401/210 |
| 5,263,786 | A | * | 11/1993 | Kageyama | 401/111 |
| 5,413,428 | A | | 5/1995 | Kageyama | 401/110 |
| 5,551,788 | A | | 9/1996 | Wacha et al. | 401/116 |
| 5,615,964 | A | | 4/1997 | Smith | 401/210 |
| 5,915,870 | A | | 6/1999 | Hamilton, Jr. | 401/210 |
| 6,062,756 | A | | 5/2000 | Sasaki | 401/111 |

FOREIGN PATENT DOCUMENTS

| | | |
|---|---|---|
| DE | 36 37 875 A1 | 11/1986 |
| EP | 000284851 A1 | 10/1988 |
| JP | 407314975 A | 12/1995 |
| JP | 409315078 A | 12/1997 |

* cited by examiner

*Primary Examiner*—Tuan N. Nguyen
(74) *Attorney, Agent, or Firm*—Jones Day

(57) ABSTRACT

A mechanism for automatically adjusting the chamber length in a writing instrument to accommodate refills of different lengths. The mechanism comprises at least first and second elements operably engaged with each other. When contacted by a refill, the second element automatically moves from a first position associated with a first chamber length to a second position associated with a second chamber length. A biasing member may releasably hold the second element in the first position. In one embodiment third element is fitted within the second element, and is operably and movably engaged with the first and second elements. When contacted by a refill, the third element automatically moves from a first position associated with a first chamber length to a second position associated with a second chamber length. A method of using an automatically-adjusting refill seat mechanism is also disclosed.

30 Claims, 10 Drawing Sheets

UNIVERSAL REFILL MECHANISM AND METHOD

FIELD OF THE INVENTION

The present invention generally relates to writing instruments, and more particularly to a writing instrument having a seat that automatically adjusts to accept refills of different lengths.

BACKGROUND OF THE INVENTION

It is commonplace for pen manufacturers to make refill cartridges that vary in diameter and length from those of their competitors. Manufacturers each typically make their pen housings with an elongated internal chamber, which encloses the refill cartridge, of a unique length to match the length of its own brand refills. Accordingly, the refill seat against which the non-writing end of the refill abuts is at a fixed position with respect to the pen housing, thereby setting the length of the refill chamber. This practice often precludes consumers from using refills from one manufacturer in other manufacturer's pens because the writing point of the refill cartridge (which delivers the ink) will not protrude from the end of the pen housing by the proper amount for writing. Thus, the point may extend either too little or too far in relation to the end of the pen housing. This situation may also interfere with the proper fitting of caps or other end closures that are typically used in non-retractable pen designs, or with the proper operation of retractable pen mechanisms.

The problems created by varying length refills may also plague a single manfacturer's line of writing instruments. Such may be the case when the consumer attempts to change the type of refill that is used in a particular pen. For example, ballpoint refills often vary in length from rollerball refills even from the same manfacturer. Therefore, different type refills cannot readily be used interchangeably with a particular pen design. This can be frustrating to consumers, particularly those who purchase reuseable quality pens which typically command a higher market price than disposable models. Thus, the consumer has little flexibility and is locked into the type of refill that can be used at the time the pen is purchased. Furthermore, the availability of refills for particular models of pens is often problematic for the consumer, especially if the model has been discontinued.

To overcome the aforementioned problems, a number of approaches have been attempted in the past with limited success to accommodate varying length refills. For instance, one common approach exemplified by U.S. Pat. No. 3,039,437 has been to provide refill cartridges with different length plugs that are intended to be manually inserted into the non-writing end of the refill by the consumer, thereby functionally altering the length of the replacement or refill cartridge. Through a trial and error process, the consumer must try to select the plug that will yield the proper length when the refill is installed in the particular pen's refill chamber (assuming that the proper plug has even been provided with the refill kit in the first instance). This potential solution is not only inconvenient for the consumer, but also increases refill cartridge costs because the manufacturer must make and supply an assortment of plugs with each refill kit.

Another approach directed towards varying the operative length of the refill itself is to provide a plastic refill that must be manually cut to proper length by the consumer as disclosed in U.S. Pat. No. 5,615,964. This approach, however, is similarly inconvenient, may result in ink leakage, and is not adaptable to many of today's metal refills such as those found in higher end pens. Yet another variation disclosed in U.S. Pat. No. 2,914,027 consists of an inner refill cartridge having a helically grooved tube with a concentric outer sleeve member which moves up and down on the tube to vary the length of the refill. After the consumer determines the proper length of the refill, the length of the refill is manually locked into place by a clamping collar which affixes the inner tube to the outer sleeve member. German patent DE 3637875 utilizes a collect chuck mechanism that grabs the refill and is adjustable to vary the position of the refill within the writing instrument with respect to the writing end of the barrel. This design also requires manual manipulation of the collet mechanism to adjust the position of the refill in the pen housing so that the refill point protrudes the proper distance for writing. The collet chuck design is also somewhat mechanically complex and not inexpensive to produce.

In sum, the design approaches of the past have inconvenienced consumers by requiring various types of manual adjustments to be made and with which the consumer would rather not be bothered. Accordingly, there is a need for a refill seat that is not only simple in design and economical to produce, but also that automatically adjusts the refill chamber length to accept refills of different lengths.

BRIEF SUMMARY OF THE INVENTION

The invention is generally directed to a refill seat for a writing instrument having an internal chamber. More particularly, the invention relates to a refill seat mechanism that automatically adjusts the length of the chamber within a writing instrument to accept refills of different lengths. Accordingly, consumers are not required to manually manipulate the writing instrument or the refill to change the chamber length. The chamber length automatically adjusts to the proper length based on the length of the refill that is inserted into the writing instrument. Briefly stated, consumers uncouple the writing instrument housing, insert the refill of choice, and recouple the writing instrument housing. The refill now automatically assumes its proper position within the writing instrument for writing (i.e., writing end of refill which delivers ink to the writing surface is projected by a correct amount beyond the front end of the instrument), and is ready to be used.

The automatically-adjusting refill seat mechanism comprises a first element having a seating surface and a second element having a seating surface. The seating surfaces, either alone or in combination, form a stop to prevent the refill from sinking into the housing chamber too far such that the writing end of the refill is not projected beyond the front of the writing instrument for writing. The second element is moveable in position with respect to and operably slidably engaged with the first element. The second element may be moveable in a continuum of positions with respect to the first element. In one embodiment, the second element is moveable from a first position to a second position with respect to the first element. The movement of the second element creates different chamber lengths which are associated with the first and second positions of the second element. Both the first and second elements are configured and adapted to fit in a writing instrument. Accordingly, the size of the first and second elements may be determined based upon the size of the writing instrument in which they will be used, but adapt to variously sized refills to be contained in the housing.

Different length refill cartridges having variously sized and configured seating ends (i.e., the end of the refill opposite the writing end) may be used with the present invention such that when inserted in a writing instrument, the refill is in the proper position for writing. Thus, the type of refill cartridge provided and its seating end design (i.e., size and configuration) will determine whether the first and/or second elements become engaged by the refill cartridge when inserted in a writing instrument having the refill seat mechanism of the present invention. Preferably, therefore, the seating surfaces of the first and second elements are cooperatively sized and configured with the length and seating end type of the different refill cartridges that may be used. For example, a first type of refill cartridge may engage the first element without engaging the second element. In another example, a second type of refill cartridge may engage the second element without engaging the first element. And in another example, a third type of refill cartridge may engage both the first and second elements. In the foregoing examples, it is apparent that the second element may either be automatically moved or not moved (as a matter of design choice) with respect to the first element to provide the correct chamber length within the writing instrument for centering the particular refill cartridge used in the proper position for writing. Thus, refills of different lengths are usable in the same writing instrument having a refill seat mechanism in accordance with the principles of the present invention. A biasing member may be interposed between the first and second elements to releasably hold the second element in the first position when not engaged by a refill; however, a biasing member is not necessary.

In one embodiment, the first element may be a rod and the second element may be a sleeve that is slidable on the rod. The biasing member may be a helical spring suitable to bias the first and second elements apart, yet permit movement of the first and second elements towards each other.

In accordance with another embodiment, a separate refill seat may be provided that is moveable from a first position to a second position with respect to the first element. The refill seat may be axially slidably engaged with the first element. In one embodiment, the movement of the seat from the first to second position creates different chamber lengths, which in an embodiment may be two chamber lengths. In another embodiment, the movement of the seat may create three different chamber lengths. The refill seat may have a head and a stem attached thereto. In another embodiment, the refill seat and the first element have mating angled surfaces to create produce the first and second positions of the seat. However, angled surfaces are not necessarily required and the first and second positions of the seat may be achieved in other ways in various embodiments.

A method is also described for using refills of different lengths in a writing instrument provided with an automatically-adjusting refill seat mechanism. The writing instrument has a housing made up of a lower portion coupled to an upper portion defining an elongated internal chamber therein for centering a refill. To use the refill seat mechanism, the lower and upper housing portions are first uncoupled and a refill is inserted into the internal chamber. The upper and lower housing portions are then recoupled, whereupon the refill seat mechanism automatically adjusts the chamber length to match and properly to fit the length of the refill selected, without requiring any manual adjustments to the length of the chamber.

BRIEF DESCRIPTION OF THE DRAWINGS

The features and advantages of the present invention will become more readily apparent from the following detailed description of the invention in which like elements are labeled similarly and in which.

DETAILED DESCRIPTION OF THE INVENTION

Figure 1:
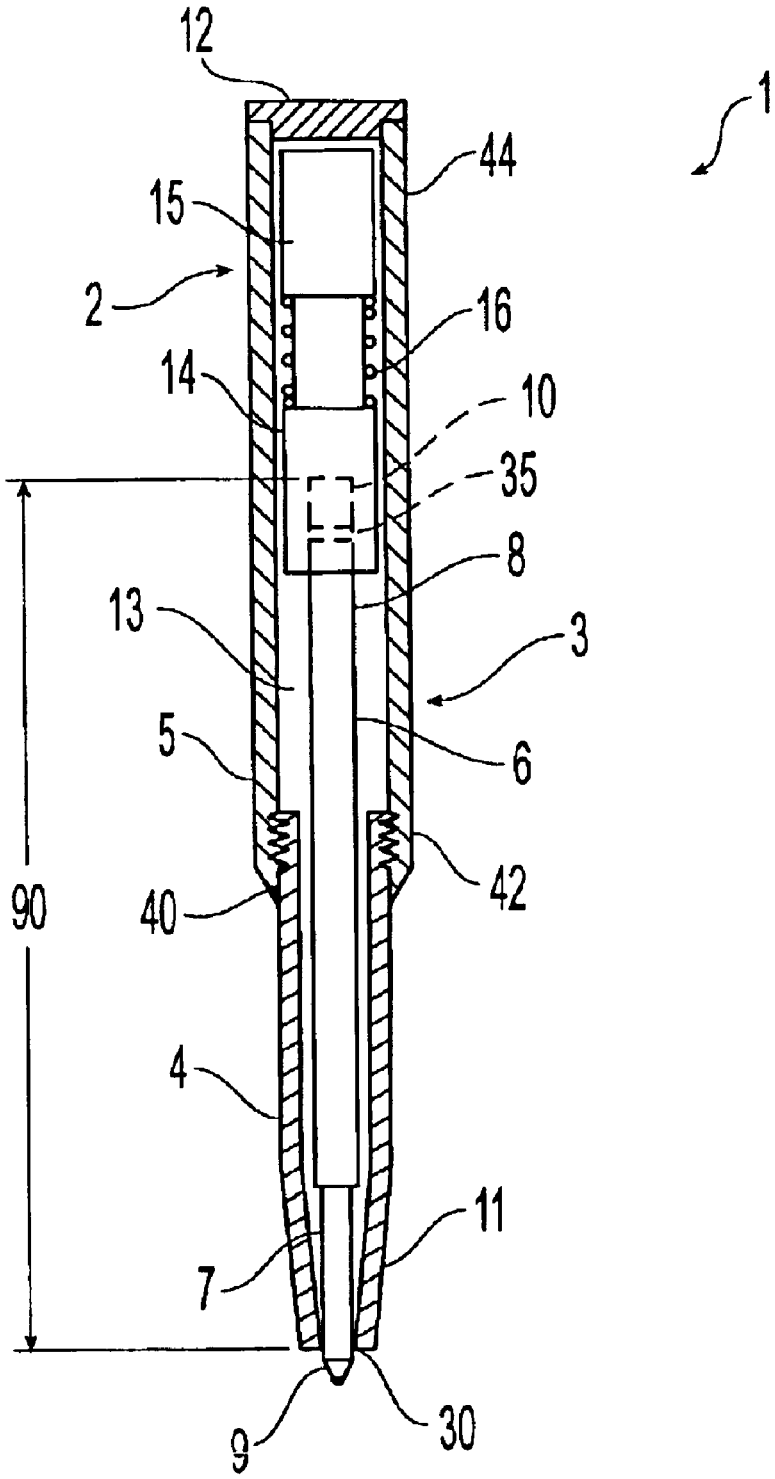
FIG. 1 is a partial cross-sectional view of a writing instrument having one embodiment of a refill seat mechanism according to the principles of the present invention in which the refill and refill seat mechanism are shown in an uncut side view.

A writing instrument 1 is shown in FIG. 1 having one embodiment of a refill seat mechanism 2 formed in accordance with the principles of the present invention. The writing instrument 1 comprises a substantially hollow housing 3 including a lower portion 4 and an upper portion 5. Lower portion 4 has a generally conical end 11 at one extremity terminating with an aperture 30 through which a refill cartridge 6 may be projected, and a joining end 40 opposite conical end 11. Upper portion 5 has a joining end 42 at one extremity and a closure end 44 opposite joining end 42 which terminates in an end closure 12. End closure 12 may be a separate component attached to or inserted in closure end 44, or end closure 12 may be formed as part of closure end 44. In the embodiment shown, lower and upper portions 4, 5 are rotatably coupled by a threaded connection at joining ends 40, 42 of lower and upper portions 4, 5, respectively. It will be appreciated that lower and upper portions 4, 5 may be coupled by any other suitable means such as a slidable friction fit, etc.

Refill cartridge 6, which is disposed in elongated internal chamber 13 of substantially hollow housing 3, has a writing end 7 and a seating end 8. An end plug 10, situated opposite writing end 7, may also be provided (see also, e.g., FIGS. 9 to 11). End plug 10 may further be configured with a shoulder 35, which may be formed as part of plug 10 that abuts seating end 8, and defines an annular surface as shown. Writing end 7 of refill 6 has a point 9 from which ink is delivered to a writing surface, and which is shown in the writing position as extending through aperture 30 in conical end 11 of lower portion 4 of housing 3. The term "ink" shall be broadly construed to mean any liquid substance of any viscosity (i.e., non-solid or non-gaseous medium) that may be used for writing or marking. When writing instrument 1 is not in use, a writing instrument cap (not shown), often having a pocket clip, may be provided to cover writing point 9. Alternatively, writing end 7 may be retractable to allow point 9 to be withdrawn into conical end 11 of lower portion 4 of housing 3.

Although writing instrument 1 shown in FIG. 1 is of the non-retractable type (i.e., refill 6 remains fixed in position relative to housing 3 such that writing end 7 always protrudes from housing aperture 30), it should be noted that refill seat mechanism 2 may also be readily used in writing instruments employing retractable-type refill mechanisms. This will be explained more fully below, following a detailed discussion of refill seat mechanism 2 and its operation.

Elongated internal chamber 13 of housing 3 is adapted and configured to contain refill cartridge 6, and, in this case, refill seat mechanism 2, which occupies a part of the upper end of chamber 13. Refill seat mechanism 2 of the embodiment of FIGS. 1–12 is comprised of sleeve 14, rod 15, biasing member 16, and seat 24 (best seen in FIGS. 2 through 7) which may be operably coupled together as a separate unit independent from the writing instrument housing 3. In use, rod 15 remains relatively stationary in relation to housing 3 while sleeve 14, which is slidably engaged with rod 15, moves axially in housing 3 with respect to rod 15 within predetermined limits. Accordingly, rod 15 may be releasably or permanently secured in chamber 13 by any means commonly known in the art such as, but not limited to press fitting, crimping, adhesives, threadable coupling, fasteners, interconnecting and mating lockable members, tabs slidable in cooperatively configured grooves, etc. It should be noted that rod 15 may also be freely inserted into upper portion 5 of housing 3 such that it abuts end closure 12 of housing 3, a retraction mechanism for capless retractable-type writing instruments (explained more fully below), or intervening internal structures (e.g., lugs, annular ledge, etc.) that may be provided in housing 3 for rod 15 to abut against. Individual components of refill seat mechanism 2 and its operation will now be described in more detail.

Figure 7:
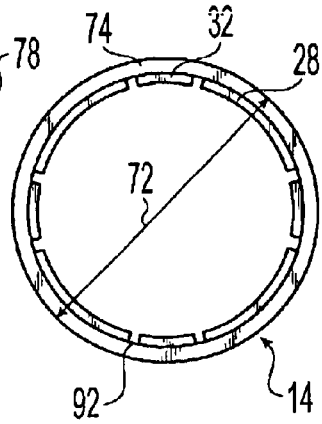
FIG. 7 is an end view, along line 7—7, of the sleeve of FIG. 6.
Figure 8:
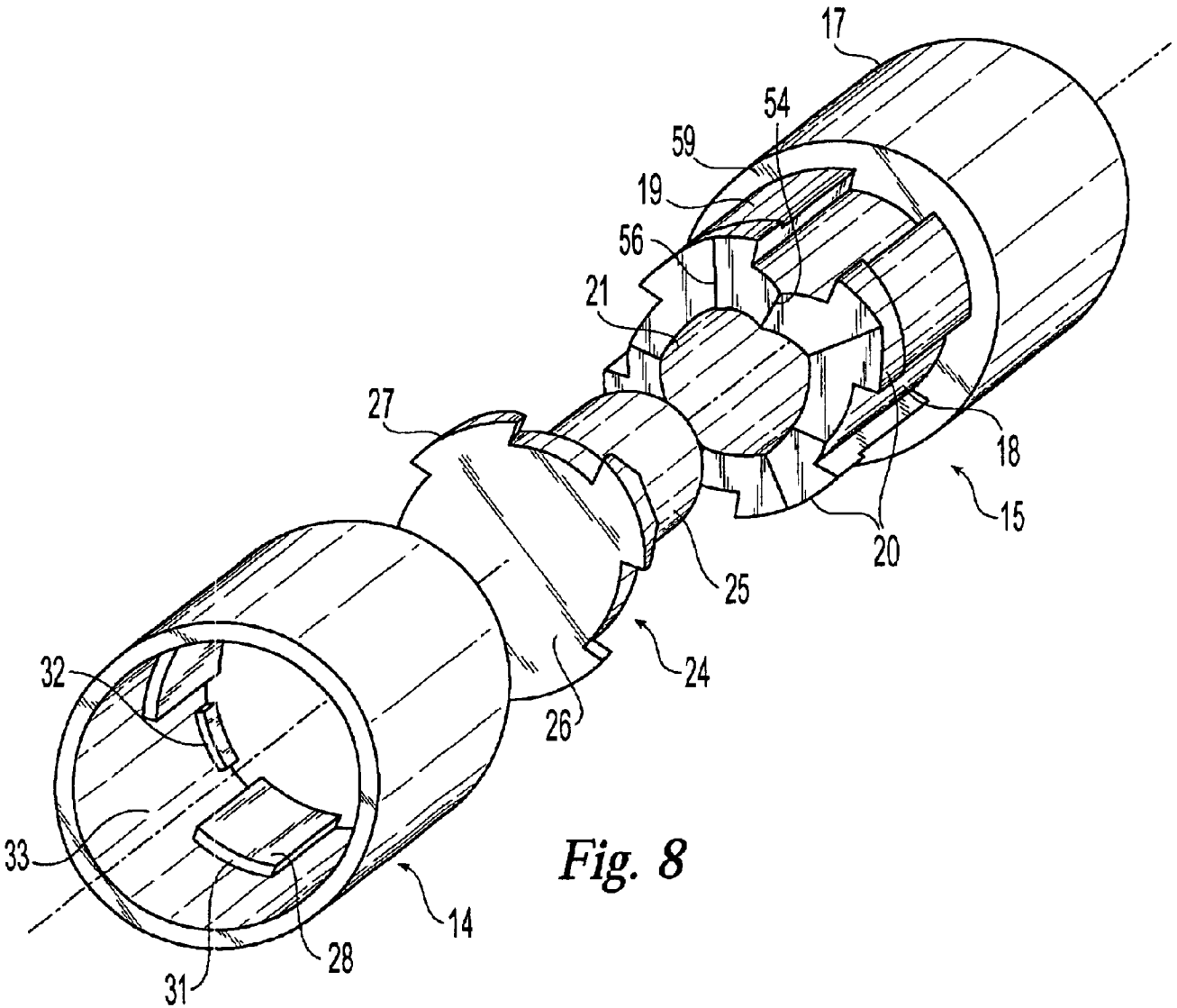
FIG. 8 is an exploded isometric view of the rod, refill seat, and sleeve of FIGS. 2–7 shown aligned and unassembled.

Referring to FIG. 8, an exploded isometric view of refill seat mechanism 2 (without biasing member 16) is shown to illustrate the relative position of sleeve 14, rod 15, and seat 24 before assembly. As shown here, and also with reference to FIGS. 2 through 7, an equal number of rod rails 19, seat raised tabs 27, and sleeve splines 28 are preferably provided and circumferentially spaced such that these members may operably interact in a spatial relationship with one another when sleeve 14, rod 15, and seat 24 are assembled. The details and interaction of sleeve 14, rod 15, and seat 24, and assembly and operation of refill seat mechanism 2, will now be described in detail.

Figure 2:
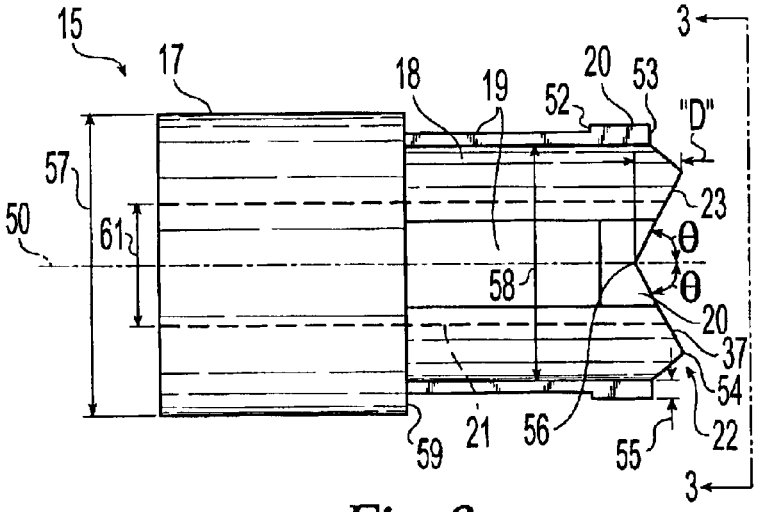
FIG. 2 is a side view of a rod of a refill seat mechanism in accordance with the principles of the present invention.
Figure 3:
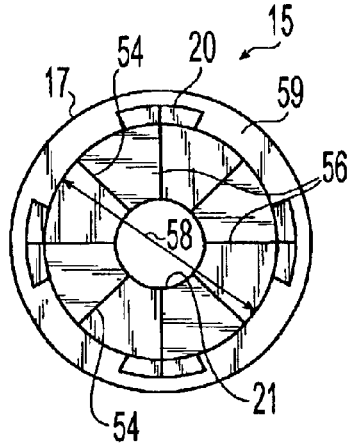
FIG. 3 is an end view, along line 3—3, of the rod of FIG. 2.

Referring first to FIGS. 2 and 3, rod 15 is preferably cylindrical in shape, although other shapes with suitable cross-sections, such as hexagonal, square, etc., may also be used. At least part of the length of rod 15 is configured and adapted to include a sleeve-receiving portion 18 on one end to operably slidably engage sleeve 14. Accordingly, the cross-sectional shape of sleeve-receiving portion 18 may be cooperatively configured with the cross-sectional shape of sleeve 14 (compare FIG. 3 with FIG. 7). Chamber-positioning portion 17, shown round in cross-section at the other end of rod 15, assists in maintaining rod 15 in a predetermined longitudinal position and concentric axial alignment within writing instrument housing 3 and elongated internal chamber 13.

It should be noted that chamber-positioning portion 17 may have a different cross-sectional shape than sleeve-receiving portion 18. Since chamber-positioning portion 17 does not slidably engage sleeve 14, its cross-sectional shape is not restricted to the shape of sleeve 14 as is sleeve-receiving portion 18, as discussed above. The cross-sectional shape of chamber-positioning portion 17 may, but need not necessarily, be selected based on the cross-sectional shape of upper portion 5 of writing instrument housing 3. Therefore, for example, sleeve-receiving portion 18 may be round in cross-section while chamber-positioning portion 17 may be square, triangular, or hexagonal. This flexibility is particularly advantageous in designer or decorative writing instrument product lines where writing instrument housings oftentimes have fashionable and unusually shaped cross sections.

Chamber-positioning portion 17 and sleeve-receiving portion 18 may be formed from one piece of material, or may be formed from two or more separate components which are connected together by any means known in the art. Preferably, outside diameter 57 of chamber-positioning portion 17 is larger than outside diameter 58 of sleeve-receiving portion 18 such that ledge 59 is formed which creates a surface against which one end 80 of biasing member 16 may be abutted (see, e.g., FIGS. 9 and 10). It should be noted that outside diameters 57, 58 of chamber-positioning portion 17 and sleeve-receiving portion 18, respectively, may be the same and alternate means may be provided to retain end 80 of biasing member 16. Sleeve-receiving portion 18 also serves as a means for concentrically guiding and centering biasing member 16 in position on refill seat mechanism 2.

Opening 21 extends at least part way into rod 15 from free end 37 and is preferably concentrically aligned therein. Alternatively, opening 21 may extend completely through rod 15, as shown. Opening 21 is configured and adapted to receive at least a portion of stem 25 of seat 24 (best seen in FIGS. 4 and 5). Accordingly, opening 21 must be at least long enough to accept stem 25 with rod 15 and seat 24 in the "meshed" condition which will be described in detail below. Preferably, opening 21 has a circular cross section, as does stem 25 of seat 24, both of which will become evident from the ensuing discussion.

Sleeve-receiving portion 18 may have raised rails 19 which extend axially along at least part of the length of sleeve-receiving portion 18 from free end 37. Rails 19 extend parallel to the longitudinal axis 50 of rod 15. At least part of raised rails 19 are slidably received in and circumferentially aligned with channels 33 of sleeve 14 (FIGS. 6 and 7) to prevent sleeve 14 and rod 15 from rotating relative to each other. Thus, the height of raised rails 19 is selected to allow for engagement with channels 33. In the embodiment shown in FIGS. 2 and 3, four rails are provided. However, other numbers of rails are also suitable, the exact number being a matter of design choice. It should be emphasized that rails 19 are not necessary for the proper operation of the refill seat mechanism 2 provided that raised ears 20, whose function is explained in detail immediately below, are supplied. Accordingly, rails 19 may be completely omitted without adversely affecting the functionality of refill seat mechanism 2.

Raised ears 20 are provided near free end 37 of sleeve-receiving portion 18 and may serve several purposes. Ears 20 are preferably substantially rectangular or square in shape; however, other suitable configurations may also be used. Preferably, ears 20 are oriented such that rear and forward edges 52, 53 are perpendicular to longitudinal axis 50 of rod 15, as shown. At least part of raised ears 20 are slidably received in and circumferentially aligned with channels 33 of sleeve 14 (FIG. 6) to prevent sleeve 14 from rotating relative to rod 15. Thus, the height of raised ears 20 is selected to allow for engagement with channels 33. Accordingly, one purpose which may be served by raised ears 20 is to longitudinally guide and axially align sleeve-receiving portion 18 in sleeve 14 so as to minimize rotation between rod 15 and sleeve 14.

It will now be apparent that raised rails 19 need not necessarily be provided for sleeve-receiving portion 18, as mentioned above, because raised ears 20 may serve the same basic purpose of preventing sleeve 14 from rotating relative to rod 15. When raised rails 19 are used in conjunction with raised ears 20, however, ears 20 are preferably superposed on rails 19 such that ears 20 and rails 19 are axially aligned with each other. Accordingly, the height of ears 20 is preferably greater than the height of rails 19 when provided. Preferably, the number of raised ears 20 provided equals the number of rails 19. In the embodiment shown in FIGS. 2 and 3, there are four raised ears 20 and four raised rails 19.

Another function which may be served by raised ears 20 is to help prevent rod 15 from being completely withdrawn from sleeve 14 after rod 15 has been initially inserted into sleeve 14. This is achieved by engagement of rear edges 52 of ears 20 with sleeve lugs 32, located within channel 33 of sleeve 14 (best seen in FIGS. 6 and 7), after rod 15 has been inserted into sleeve 14 with forward edges 53 of raised ears 20 entering sleeve 14 first. To ease insertion of rod 15 into sleeve 14, forward edges 53 of raised ears 20 may be chamfered (not shown) to allow raised ears 20 to readily ride over sleeve lugs 32. These aspects of the invention will be described in further detail below.

Free end 37 of sleeve-receiving portion 18 has a plurality of angled surfaces 22 created by tooth-like appurtenances which define a series of peaks 54 and valleys 56. The tops of peaks 54 and bottoms of the valleys 56 may have sharp intersections, as shown in FIG. 2, or they may be slightly rounded. Ramps 23 join peaks 54 and valleys 56 of angled surfaces 22 which may intersect at any suitable angle θ in relation to longitudinal axis 50; the selection of angle θ being largely a matter of design choice.

It will be further appreciated that angle 0 is also determined in part by the desired engagement depth "D" shown in FIG. 2. Engagement depth "D" varies inversely with angle θ. Accordingly, angle θ becomes increasingly smaller as desired depth "D" becomes increasingly larger. In addition, it will be apparent that angle θ may also vary in part depending on the number of tooth-like appurtenances provided. For example, as the number of tooth-like appurtenances provided for a given engagement depth "D" increases, angle θ becomes smaller.

It should be noted that the number of tooth-like appurtenances forming angled surfaces 22 may vary with the difference in the lengths of the refills to be used in writing instrument 1. As explained in greater detail below, the required engagement depth "D" is approximately equal to the distance refill seat mechanism 2 must move to accommodate different length refills in writing instrument 1. Accordingly, the engagement depth "D" may determine in part the number of tooth-like appurtenances that would be optimum under certain design conditions.

Rod 15 is preferably made of plastic, but alternatively may be made of metal or any other suitable material which can provide the required functionality which will become evident as discussed below.

Figure 4:
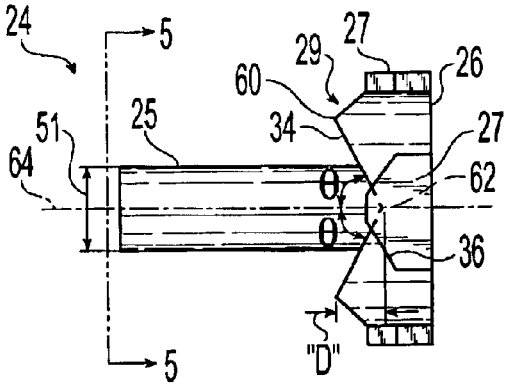
FIG. 4 is a side view of a refill seat of a refill seat mechanism in accordance with the principles of the present invention.
Figure 5:
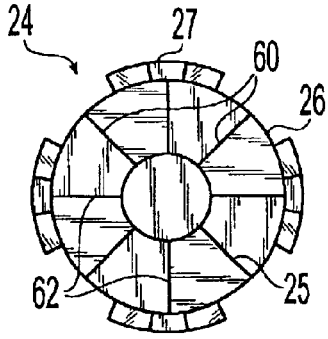
FIG. 5 is an end view, along line 5—5, of the refill seat of FIG. 4.

Referring now to FIGS. 4 and 5, seat 24 is comprised of a head 26 and a cylindrical stem 25. Preferably, stem 25 is cylindrical in shape and has a diameter 51 cooperatively sized with diameter 61 of opening 21 of rod 15 so that seat 24 may rotate and slide in relation to rod 15 when stem 25 is inserted in opening 21 of rod 15. Stem 25 also assists in keeping seat 24 and rod 15 concentrically aligned.

Head 26 is preferably a substantially flat disc and has raised tabs 27 whose function will be described below. At least part of tabs 27 are shaped and configured to be slidably received in and axially aligned with channels 33 of sleeve 14 (FIG. 6) to prevent seat 24 from rotating relative to sleeve 14 when tabs 27 are situated in channels 33. When tabs 27 are not situated in channels 33, seat 24 is free to rotate in relation to sleeve 14, the function of which will be described in further detail below. Tabs 27 may further have angled sides 36 which converge toward the stem end of head 26. Angled sides 36 may meet in a small, substantially flat intersection as shown, or in a pointed or slightly rounded manner (not shown), which is a matter of design choice.

The stem side of head 26 further comprises angled surfaces 29, defining a series of peaks 60 and valleys 62, corresponding to peaks 54 and valleys 56 of rod 15, as shown. Ramps 34 connect peaks 60 and valleys 62. Angled surfaces 29 are cooperatively configured and adapted to mate with angled surfaces 22 of sleeve-receiving portion 18 of rod 15 such that angled surfaces 22, 29 are capable of meshing together. Thus, peaks 60 and valleys 62 preferably intersect at angle θ with respect to longitudinal axis 64 of seat 24 that is correspondingly selected to match angle θ of angled surfaces 22 of rod 15.

Seat 24 is preferably made of plastic, but alternatively may be made of metal or any other suitable material which can provide the required functionality which will become evident as discussed below.

Figure 6:
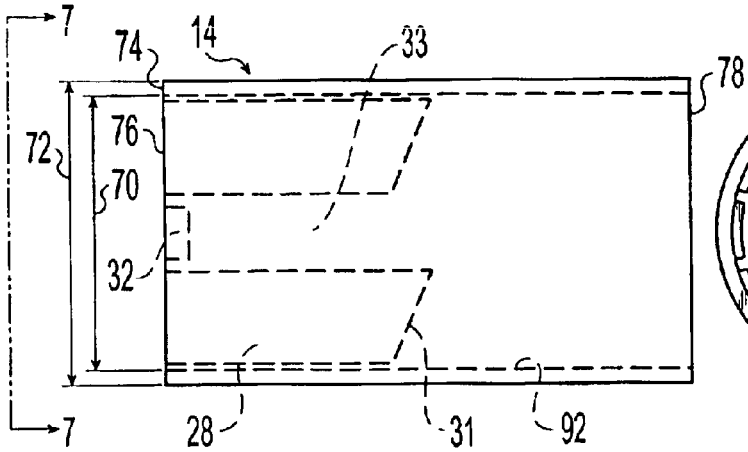
FIG. 6 is a side view of a sleeve of a refill seat mechanism in accordance with the principles of the present invention.

FIGS. 6 and 7 show sleeve 14 of refill seat mechanism 2 which is a substantially hollow cylinder in shape. Splines 28 may be provided which rise from inside surface 92 of sleeve 14 and preferably are formed as part of sleeve 14. Splines 28 have angled ends 31 which are intended to interact with angled sides 36 of raised tabs 27 of seat 24 as will be described in further detail below. The splines 28 define channels 33 between adjacent splines on inside surface 92 of sleeve 14. Preferably, the number of splines 28 equals the number of raised ears 20 provided on rod 15. In the embodiment shown in FIGS. 6 and 7, sleeve 14 has four splines.

Raised lugs 32 rise from inside surface 92 of sleeve 14 and are preferably located at or near the ends of channels 33 opposite angled ends 31 of splines 28. Raised lugs 32 need only be relatively short in length, since they are intended to engage raised ears 20 of rod 15 to prevent rod 15 from being withdrawn from sleeve 14 after rod 15 has been inserted in sleeve 14. Preferably, lugs 32 are formed as part of the sleeve 14; however, lugs 32 may be separate appurtenances attached to inside surface 92 of sleeve 14.

Inside diameter 70 of sleeve 14 is cooperatively sized with outside diameter 58 of sleeve-receiving portion 18 and height 55 of raised ears 20 of rod 15 (FIG. 2) such that sleeve-receiving portion 18 may slide inside sleeve 14. Furthermore, annular surface 74, formed on rod receiving end 76 of sleeve 14 by the difference between outside diameter 72 and inside diameter 70 (FIGS. 6 and 7), creates a surface against which end 82 of biasing member 16 may be abutted (see, e.g., FIGS. 9 and 10).

Sleeve 14 is preferably made of plastic, but alternatively may be made of metal or any other suitable material which can provide the required functionality which will become evident as discussed below.

It should first be noted that for clarity in describing the features and operation of the invention, FIGS. 9 through 14 show upper portion 5 of housing 3 of writing instrument 1 in partial cross-section to reveal refill seat mechanism 2. Sleeve 14 is shown in longitudinal cross-section to reveal more clearly the interaction of rod 15 with refill seat 24. Angled ends 31 of splines 28 and lugs 32 of sleeve 14 (see FIGS. 6 and 7) are shown only in phantom lines where they would be generally located for reference purposes to better show the relative relation (in the embodiments depicted) of splines 28 and lugs 32 of sleeve 14 with respect to the various appurtenances of rod 15 and refill seat 24.

In general, to accommodate refills of different lengths, refill seat mechanism 2 automatically adjusts to different seat positions which effectively changes the length of internal chamber 13 within writing instrument 1, thereby ensuring proper seating of refills therein for writing. As shown in FIG. 1, chamber length 90 of chamber 13 defines the internal space within housing 3 which is occupied by a refill. With initial reference to a first seat position shown in FIG. 9, an assembled refill seat mechanism 2 is depicted in writing instrument 1 as being engaged with an inserted refill cartridge 6. With additional reference to FIGS. 2 through 7, refill seat mechanism 2 may initially be assembled in the embodiment depicted by placing biasing member 16 onto sleeve-receiving portion 18 of rod 15. Preferably, biasing member 16 is a helical spring as shown; however, any other suitable type of biasing member may be used. Sleeve-receiving portion 18 of rod 15 is next pushed into rod receiving end 76 of sleeve 14 (FIGS. 6 and 7), such that rod 15 and sleeve 14 are slidably engaged with each other. Raised ears 20 of rod 15 (and raised rails 19 if provided) are free to move axially within the confines of channels 33 of sleeve 14. Relative rotational movement between rod 15 and sleeve 14, however, is prevented by the interaction between raised rails 19 and raised ears 20 of rod 15 and splines 28 of sleeve 14. Once sleeve-receiving portion 18 of rod 15 has been inserted into sleeve 14, lugs 32 are designed to assist in preventing rod 15 from being completely withdrawn from sleeve 14 by engaging raised ears 20 of rod 15 as sleeve 14 is pushed back. Refill seat mechanism 2 may then be placed within writing instrument 1.

After rod 15 has been inserted into sleeve 14, seat 24 will next normally be inserted, stem first, into refill-receiving end 78 (see FIG. 6) of sleeve 14. Alternatively, seat 24 may be inserted into sleeve 14 before rod 15 is inserted.

Alternatively, refill seat mechanism may initially be assembled within writing instrument 1 by positioning rod 15 within internal chamber 13. Preferably, biasing member 16 is placed on rod 15 before insertion into writing instrument 1. Sleeve 14 may then be pushed onto rod 15, followed by insertion of seat 24 into sleeve 14 as described above.

Figure 9:
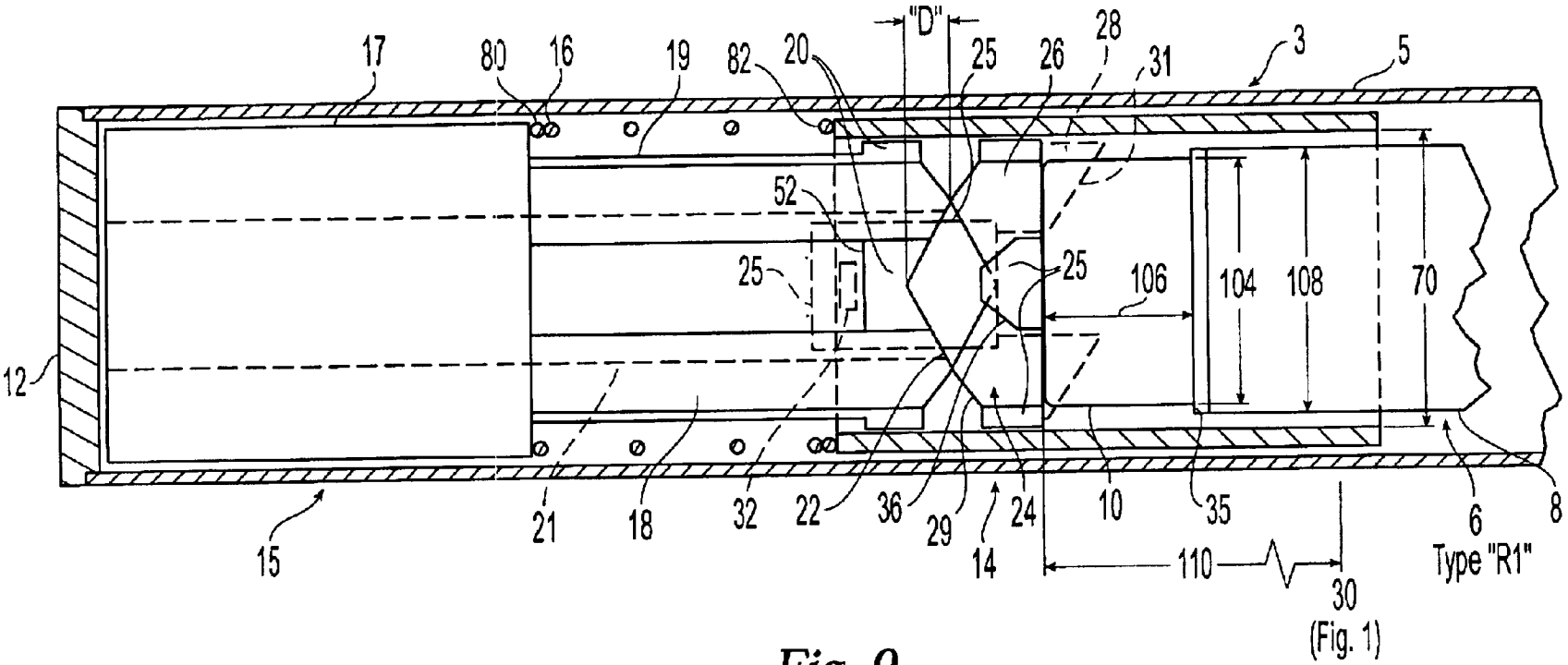
FIG. 9 is a partial cross-sectional enlarged view of part of the upper portion of a writing instrument having a refill seat mechanism in which the refill seat and rod are in an unmeshed relation with each other, and the sleeve is in a sleeve forward position.
Figure 10:
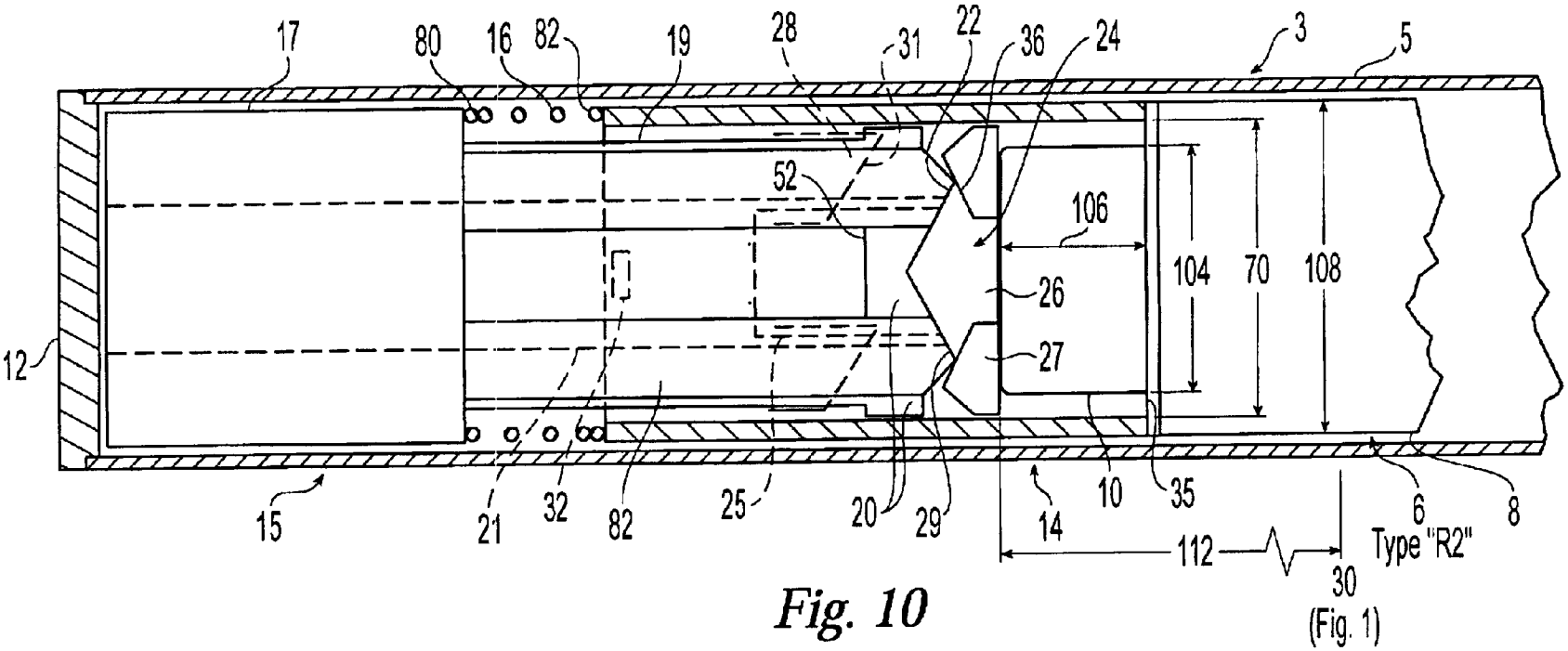
FIG. 10 is a partial cross-sectional enlarged view of part of the upper portion of a writing instrument having a refill seat mechanism in which the refill seat and rod are in a meshed relation with each other, and the sleeve is in a sleeve back position.

With continuing reference to FIG. 9, biasing member 16 applies an axial force to maintain sleeve 14 in what will be called the "sleeve forward" position in relation to rod 15. In this position, sleeve 14 is at a maximum distance from chamber-positioning portion 17 of rod 15, wherein rear edges 52 of raised ears 20 abut lugs 32 of sleeve 14. Biasing member 16 should be selected with a proper spring coefficient (k) such that the axial force generated by biasing member 16 is great enough to hold the sleeve 14 in the "sleeve forward" position as shown in FIG. 9, but not so great to prevent sleeve 14 from being readily slid back towards rod 15 to the "sleeve back" position as shown in FIG. 10 when one type of refill 6 (designated "R2" and shown in FIG. 10) is inserted into the writing instrument 1, as will be explained in more detail below. Preferably, a light spring is provided with a light to moderate spring force whose selection is well within the common knowledge of those skilled in the art. Internal diameter 86 of biasing member 16 is preferably and nominally selected so that biasing member 16 may be retained in place between chamber-positioning portion 17 and sleeve 14, which are both preferably larger in diameter than sleeve-receiving portion 18 of rod 15, as shown. It should be noted that numerous other suitable means and arrangements are possible, however, for retaining the biasing member 16 in its desired position, as will be readily known to those of ordinary skill in the art.

With continuing reference to FIGS. 2–7 and 9, seat 24 is slidably engaged with sleeve 14. Conceptually similar to the manner in which rod 15 engages sleeve 14 described above, raised tabs 27 on head 26 of seat 24 are free to move axially within the confines of channels 33 of sleeve 14. Relative rotational movement between seat 24 and sleeve 14 is prevented by the interaction between raised tabs 27 of seat 24 and splines 28 of sleeve 14. Thus, both tabs 27 of seat 24 and raised ears 20 of rod 15 may move axially in concert with each other within channels 33 of sleeve 14.

As shown in FIG. 9, preferably the orientation of angled surfaces 22 of rod 15 with respect to raised ears 20 and rails 19 is cooperatively configured with the orientation of angled surfaces 29 of seat 24 with respect to tabs 27, such that both angled surfaces 22, 29 are not allowed to mesh with each other so long as ears 20 and tabs 27 remain within channels 33 of sleeve 14. This shall be referred to as the "unmeshed" condition of angled surfaces 22, 29 and creates a first position of seat 24 which corresponds to a first chamber length 110. As shown, the type of refill 6 selected in this case is such that outside diameters 108, 104 of seating end 8 and end plug 10 (FIG. 1), respectively, are both smaller than inside diameter 70 of sleeve 14 (FIG. 6). This shall be referred to as a type "R1" refill for convenience. Thus when a type "R1" refill 6 is inserted into chamber 13 of writing instrument 1, and the lower and upper portions 4, 5 of writing instrument housing 3 are coupled together, end plug 10 abuts seat 24 rather than sleeve 14 and biasing member 16 is not compressed (i.e., sleeve 14 stays in the "sleeve forward" position). Accordingly, head 26 of seat 24 and raised ears 20 of rod 15 remain within channels 33 of sleeve 14. It should be noted that chamber length 110 created by the "unmeshed condition" is selected and designed such that when refill 6 of the "R1" type as shown is inserted into the writing instrument 1, tip 9 of refill 6 may project beyond aperture 30 of lower portion 4 of housing 3 by the proper amount for writing.

FIG. 10 shows an assembled refill seat mechanism 2 in a writing instrument 1 that is engaged with a different type of refill cartridge 6 that places seat 24 in a different writing position. The type of refill 6 used in this instance preferably has a seating end 8 with an outside diameter 108 at least larger than inside diameter 70 of sleeve 14. Outside diameter 104 of end plug 10 is smaller than inside diameter 70 of sleeve 14. This shall be referred to as a type "R2" refill for convenience. Accordingly, the type "R2" refill end plug 10 fits inside sleeve 14. Seating end 8, however, will not fit inside sleeve 14 because outside diameter 108 of seating end 8 is larger than inside diameter 70 of sleeve 14. Thus, when a type "R2" refill 6 is inserted into writing instrument 1, and lower and upper portions 4, 5 of the housing 3 are coupled together, seating end 8 engages sleeve 14. Accordingly, sleeve 14 is pushed back towards chamber-positioning portion 17 of rod 15, thereby compressing biasing member 16 because rod 15 remains stationary in its position in relation to writing instrument housing 3. This shall be referred to as the "sleeve back" position.

Although sleeve 14 is shown in the "sleeve back" position in FIG. 10 such that biasing member 16 has been only partially compressed when a type "R2" refill is used, the invention is explicitly not limited in this regard. Accordingly, refill seat mechanism 2 may be designed such that biasing member 16 is fully compressed when sleeve 14 is in the "sleeve back" position; the design being a matter of choice.

As sleeve 14 is pushed back on rod 15 by refill "R2," seat head 26 emerges from channels 33 in the axial direction, and moves beyond angled ends 31 of sleeve splines 28. Stem 25 of seat 24 remains engaged in opening 21 of rod 15 and is free to turn therein. Having moved beyond angled ends 31, seat head 26 is now free to move rotationally within and with respect to sleeve 14. Angled surfaces 22 of rod 15 (heretofore "unmeshed" with angled surfaces 29 of seat 24 while within the physical bounds of channel 33) similarly move beyond angled ends 31 of sleeve splines 28 as sleeve 14 becomes pushed back so that angled surfaces 22 are no longer confined in channels 33. Angled surfaces 22, 29 of rod 15 and seat 24, respectively, now are free to mesh having both moved beyond angled ends 31 of sleeve splines 28. Angled surfaces 22 and 29 cannot mesh while confined in channels 33 because angled surfaces 22 and 29 are preferably not oriented in meshing alignment with each other while confined in channels 33. It will be appreciated that angled surfaces 22 of rod 15 need only move at least far enough beyond sleeve splines 28 to allow seat head 26 to rotate so that angled surfaces 22, 29 may be moved into alignment and mesh.

With continuing reference to FIG. 10, the length of refill end plug 10 is selected and sized to maintain pressure against seat head 26 while lower and upper portions 4, 5 of writing instrument 1 are coupled together. The pressure exerted by refill 6, and the unaligned orientation of angled surfaces 22, 29 of rod 15 and seat 24, respectively (as explained in detail below), cause seat 24 to rotate and to drop into rod 15. Angled surfaces 22, 29 of rod 15 and seat 24, respectively, now become meshed in what shall be referred to as the "meshed" condition of angled surfaces 22, 29. As shown with continuing reference to FIG. 10, this creates a second position of seat 24 which corresponds to a second chamber length 112 which is longer than the first chamber length 110. Accordingly, second chamber length 112 makes it possible to use a refill cartridge 6 having a greater length than can be used with first chamber length 110 (see and compare FIGS. 9 and 10). With reference to FIG. 9, the chamber length changes by an amount equal to engagement depth "D" (see also FIGS. 2 and 4) as shown in moving from first chamber length 110 to second chamber length 112 shown in FIG. 10.

It should be noted from the previous discussion that rod 15 is prevented from moving rotationally with respect to sleeve 14 as its angled surfaces 22 emerge from sleeve chambers 33 formed by splines 28. This can be accomplished in at least two ways. In one embodiment, the length of raised ears 20 of rod 15 (FIG. 2) may be sized so that ears 20 do not completely emerge from sleeve splines 28 and channel 33 (i.e., part of ears 20 remain in sleeve channel 33), thereby preventing rotational movement of rod 15. Alternatively, if raised rails 19 are provided on rod 15 (FIG. 2), rails 19 remain within the confines of sleeve channel 33, also preventing rotational movement of rod 15. Alternatively, a combination of these rotational prevention elements using raised rails 19 and ears 20 may also be used.

Angled surfaces 22, 29 of rod 15 and seat 24, respectively, may be cooperatively oriented such that peaks 54, 60 of rod 15 and seat 24 substantially align with each other (peak-to-peak) when in the "unmeshed" condition within channels 33 of sleeve 14 (see FIG. 9). The inherent instability of peak-to-peak contact (which is maintained while peaks 54, 60 are within channels 33 of sleeve 14 as described above) cannot be maintained once peaks 54, 60 (See FIGS. 2 and 4) emerge from channels 33 when end plug 10 contacts seat 24 as a type "R2" refill is inserted into writing instrument 1. Thus seat 24 rotates in relation to sleeve 14 and angled surfaces 22, 29 would mesh.

Preferably, angled surfaces 22, 29 are oriented such that a slightly off-peak arrangement is created in the "unmeshed" condition (i.e., peaks 54 of rod 15 contact at least a part of ramps 34 of seat 24, and peaks 60 of seat 24 contact at least a part of ramps 23 of rod 15). This arrangement would assist in automatically imparting a turning motion to seat 24, as described above, once raised tabs 27 of head 26 clear channels 33 of sleeve 14, thereby allowing seat 24 to rotate and to cause angled surfaces 22, 29 to mesh. It should be noted, however, that either arrangement and orientation of angled surfaces 22, 29 described above is suitable.

It should be mentioned that the amount by which chamber length 90 defined between seat head 26 and aperture 30 (FIG. 1) increases or decreases will be determined by and is equal to the engagement depth "D" selected for angled surfaces 22, 29 (measured between peaks 54, 60 and valleys 56, 62) of rod 15 and seat 24, respectively (see "D" in FIGS. 2 and 4). As discussed above, chamber length 90 in the embodiment shown in FIGS. 9 and 10 changes by an amount equal to "D" as angled surfaces 22, 29 of rod 15 and seat 24, respectively, go from the "unmeshed" (FIG. 9) to the "meshed" (FIG. 10) condition. Accordingly, depth "D" also represents the difference in length between refill types "R1" and "R2" which in the writing instrument industry may typically be, but is not limited to, between about 1/16 and 3/8 of an inch.

It should briefly be noted at this point that when rod 15 and seat 24 are in the "meshed" condition as shown in FIG. 10 (with sleeve 14 in the "sleeve back" position), raised tabs 27 of seat head 26 (FIG. 4) are preferably designed to be substantially in axial alignment over angled ends 31 of sleeve splines 28 (FIG. 6). When sleeve 14 is returned to the "sleeve forward" position shown in FIG. 9, angled sides 36 of tabs 37 are engaged by angled ends 31 of sleeve splines 28 to impart a turning motion to seat 24 to move seat 24 to the "unmeshed" condition with rod 15. This aspect of the invention will be further described below in conjunction with changing a refill.

When the user desires to change refill 6 (presently a type "R2" refill in continuing reference to the previous example with sleeve 14 in the "sleeve back" position), lower and upper portions 4, 5 of writing instrument housing 3 are uncoupled. This action allows heretofore compressed biasing member 16 to return to its full uncompressed length, thereby concomitantly moving sleeve 14 from the "sleeve back" to the "sleeve forward" position. As this occurs, raised ears 20 and rails 19 of the rod 15 drop back into the channels 33 in sleeve 14. The writing instrument is now ready to accept another refill type "R2," or an "R1" type refill.

If a shorter length type "R1" refill is now inserted before writing lower and upper portions 4, 5 are recoupled, refill seating end 8 and end plug 10 push seat 24 back toward channels 33 in sleeve 14. This causes angled ends 31 of sleeve spline 28 to operably engage angled sides 36 of raised tabs 27 of seat head 26, as explained above. This imparts a turning action to seat 24 which aligns raised tabs 27 with channels 33, thereby allowing seat 24 to drop back into channels 33. Angled surfaces 22, 29 of rod 15 and seat 24, respectively, are now back in their initial "unmeshed" condition with seat 24 in the first position.

If a longer length type "R2" refill is inserted back into writing instrument 1 instead, angled surfaces 22, 29 of the rod 15 and seat 24, respectively, assume their "meshed" condition in the same manner described above with seat 24 reaching the second position.

Figure 11:
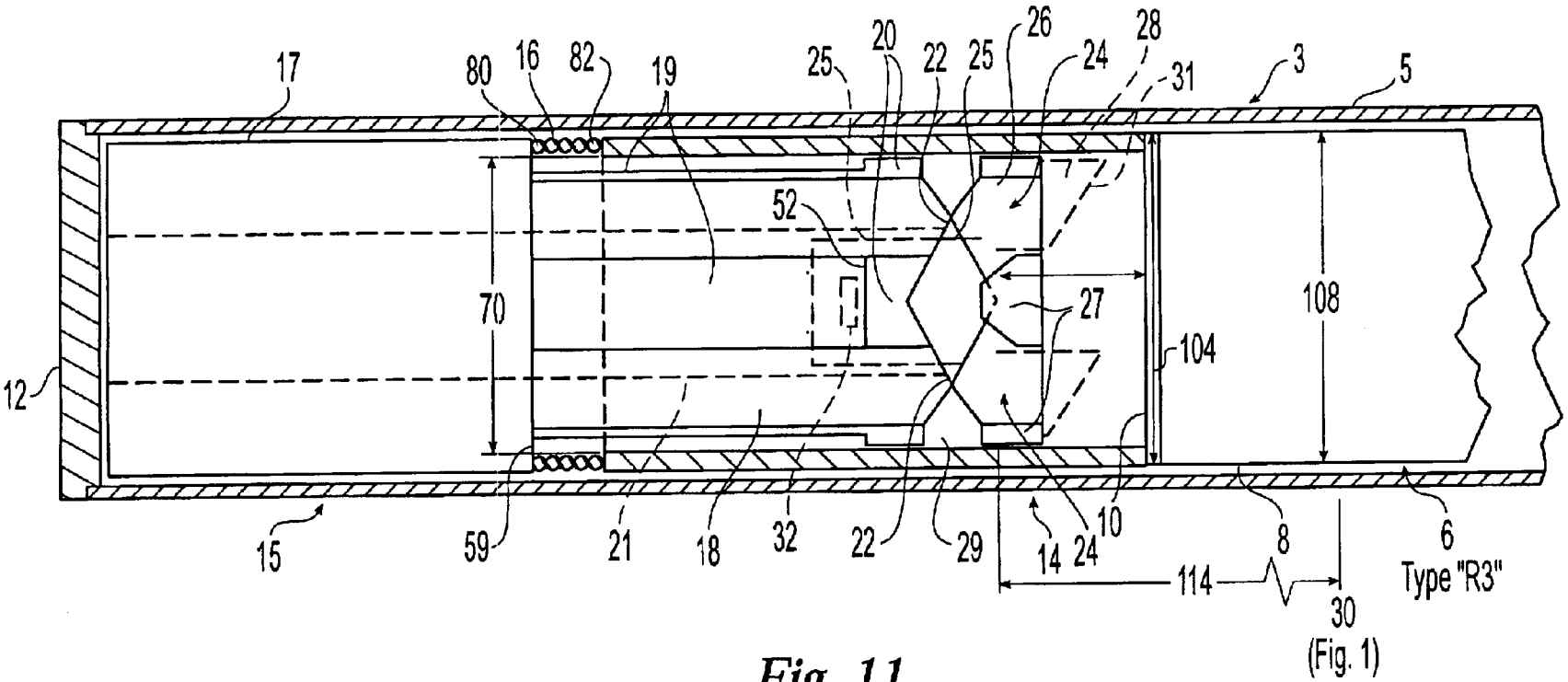
FIG. 11 is a partial cross-sectional enlarged view of part of the upper portion of a writing instrument having a refill seat mechanism in which the refill seat and rod are in an unmeshed relation with each other, and the sleeve is in a sleeve back position.
Figure 12:
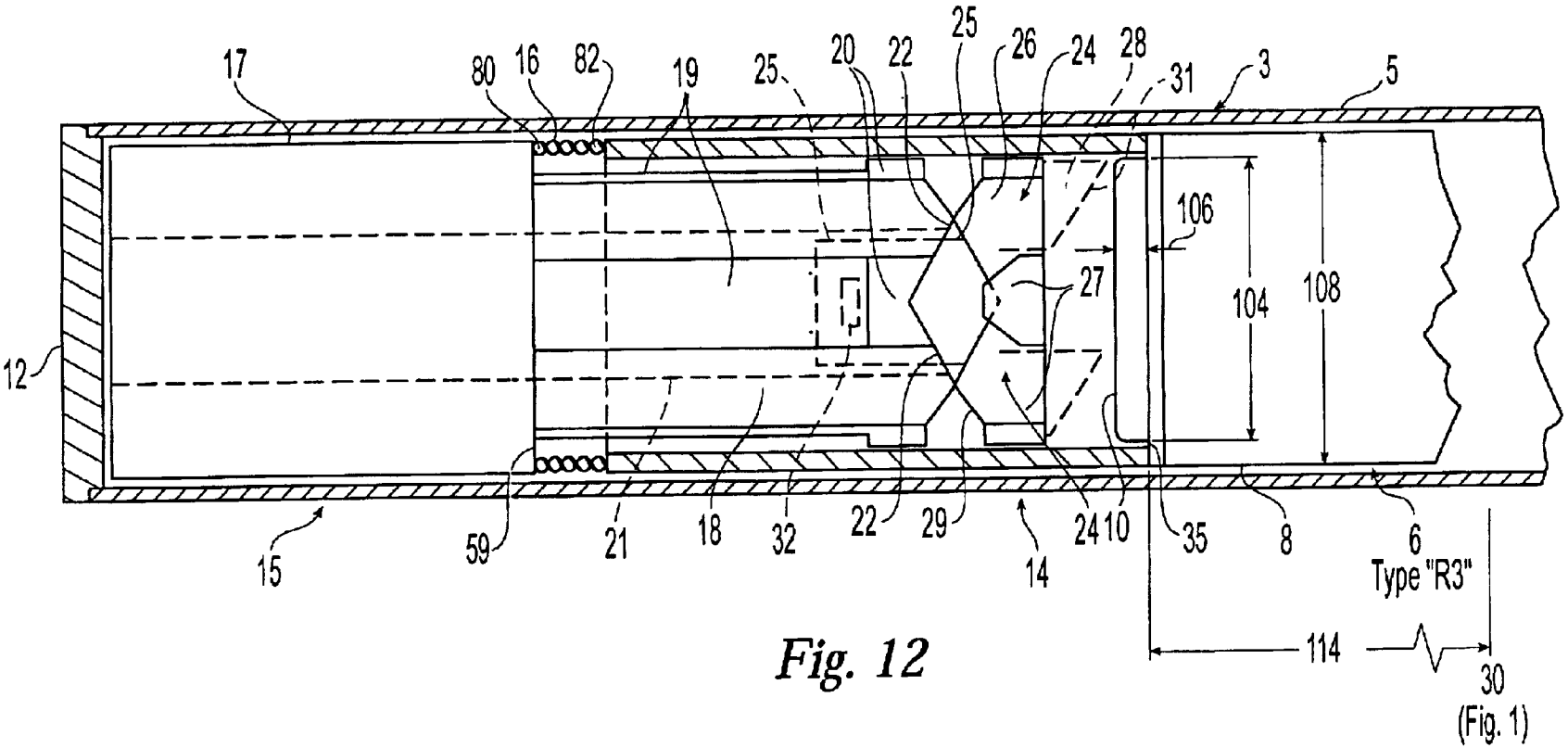
FIG. 12 is a partial cross-sectional enlarged view of part of the upper portion of a writing instrument having a refill seat mechanism in which the refill seat and rod are in an unmeshed relation with each other, and the sleeve is in a sleeve back position.

Another embodiment of a refill seat mechanism formed using the principles of the invention is shown in FIGS. 11 and 12, wherein three different chamber lengths are provided to accommodate three different types of refills having different lengths. The embodiments shown in FIGS. 9 and 10 described above, using refill types "R1" and "R2," provide a first and a second chamber length 110, 112, respectively. A third chamber length 114 is formed by the principles described in conjunction with FIGS. 11 and 12 which follow.

As shown in FIG. 11, one embodiment of a type "R3" refill has a substantially flat end plug 10 that lacks a shoulder 35 (as in refill types "R1" or "R2," shown in FIGS. 9 and 10, respectively). Accordingly, outside diameter 104 of end plug 10 is substantially equal to outside diameter 108 of refill seating end 8, as shown. Outside diameter 108 of end plug 10 is sized to be larger than inside diameter 70 (FIG. 6) of sleeve 14. Thus, no portion of plug 10 is capable of entering refill-receiving end 78 of sleeve 14 or engaging seat 24, as shown.

Alternatively, to assist in keeping refill type "R3" concentrically aligned inside chamber 33 of writing instrument 1, end plug 10 may be configured with a shoulder 35, as shown in FIG. 12. In this embodiment, end plug 10 is designed to have an outside diameter 104 that is smaller than inside diameter 70 of sleeve 14 which allows end plug 10 to be received in sleeve 14. Shoulder 35 has an outside diameter 108 that is larger than inside diameter 70 of sleeve 14. Length 106 of end plug 10 is sized such that end plug 10 is long enough to enter and operably to engage refill-receiving end 78 of sleeve 14 for concentric stability, but short enough such that plug 10 does not contact and operably engage seat 24 of refill seat mechanism 2 before biasing member 16 is fully compressed by sleeve 14 against ledge 59 of rod 15, as shown. Therefore, axial movement of sleeve 14 is limited by full compression of biasing member 16, and not by contact and engagement of end plug 10 with 35 refill seat 24.

When writing instrument 1 is intended to accommodate a type "R3" refill, refill mechanism 2 is designed such that biasing member 16 is not fully compressed when a type "R2" refill is used, as described above and shown in FIG. 10. This leaves sufficient clearance in writing instrument housing 3 to form the third chamber length 114, as described below.

With reference to FIGS. 11 and 12, when a type "R3" refill is inserted into writing instrument 1, and lower and upper portions 4, 5 of housing 3 are coupled, refill end plug 10 engages and pushes back so that sleeve 14 slides towards chamber-positioning portion 17 of rod 15. In one embodiment, sleeve 14 continues to slide back and fully compresses biasing member 16 against ledge 59 of rod 15, which serves as a backstop to limit the axial travel of sleeve 14. This shall be referred to as the "sleeve back maximum" position of sleeve 14, in which sleeve 14 is pushed back farther towards chamber-positioning portion 17 of rod 15 than when sleeve 14 is in the "sleeve back" position described above. Thus a third chamber length 114 associated with a type "R3" refill may be created, third chamber length 114 being different from either chamber lengths 110 or 112 resulting from use of an "R1" or "R2" type refill as shown in FIGS. 9 and 10, respectively. In one embodiment, refill type "R3" may be longer than refill types "R1" or "R2."

It should be noted that in another embodiment, third refill chamber length 114 may be variable, but different than either chamber lengths 110 ro 112. Preferably, this may be achieved by making the length of a type "R3" refill between a length which fully compresses biasing member 16 (as described above) at one extreme to a length at the other extreme which partially compresses biasing member 16, but wherein biasing member 16 is compressed just slightly more than that required for a type "R2" refill which also partially compresses biasing member 16 (as previously described). Accordingly, a continuum of third chamber lengths 114 between and including the foregoing extremes is possible. Preferably, biasing member 16 is designed to have a spring coefficient (k) which is: (i) strong enough to keep refill point 9 extended sufficiently far beyond writing instrument housing aperture 30 in a proper position for writing when refill point 9 is pressed against a writing surface, while (ii) not overly strong to allow sleeve 14 to be pushed back a proper amount by a type "R3" refill when the refill is initially inserted in writing instrument 1 and the lower and upper housing portions 4, 5 are coupled together. Determination of the proper spring coefficient (k) is well within the purview of those skilled in the art without undue experimentation and will not be discussed herein.

The embodiment shown in FIGS. 11 and 12 will have applicability where, for example, a type "R1" ink refill, a type "R2" rollerball refill, and any other type of "R3" refill (e.g., gel ink, felt tip, personal digital assistant ("PDA")

non-ink stylus, or other) is desired to be usable and interchangeable at the consumer's discretion in a single writing instrument 1. Refill types "R1," "R2," and "R3" have different lengths as described above.

Figure 13:
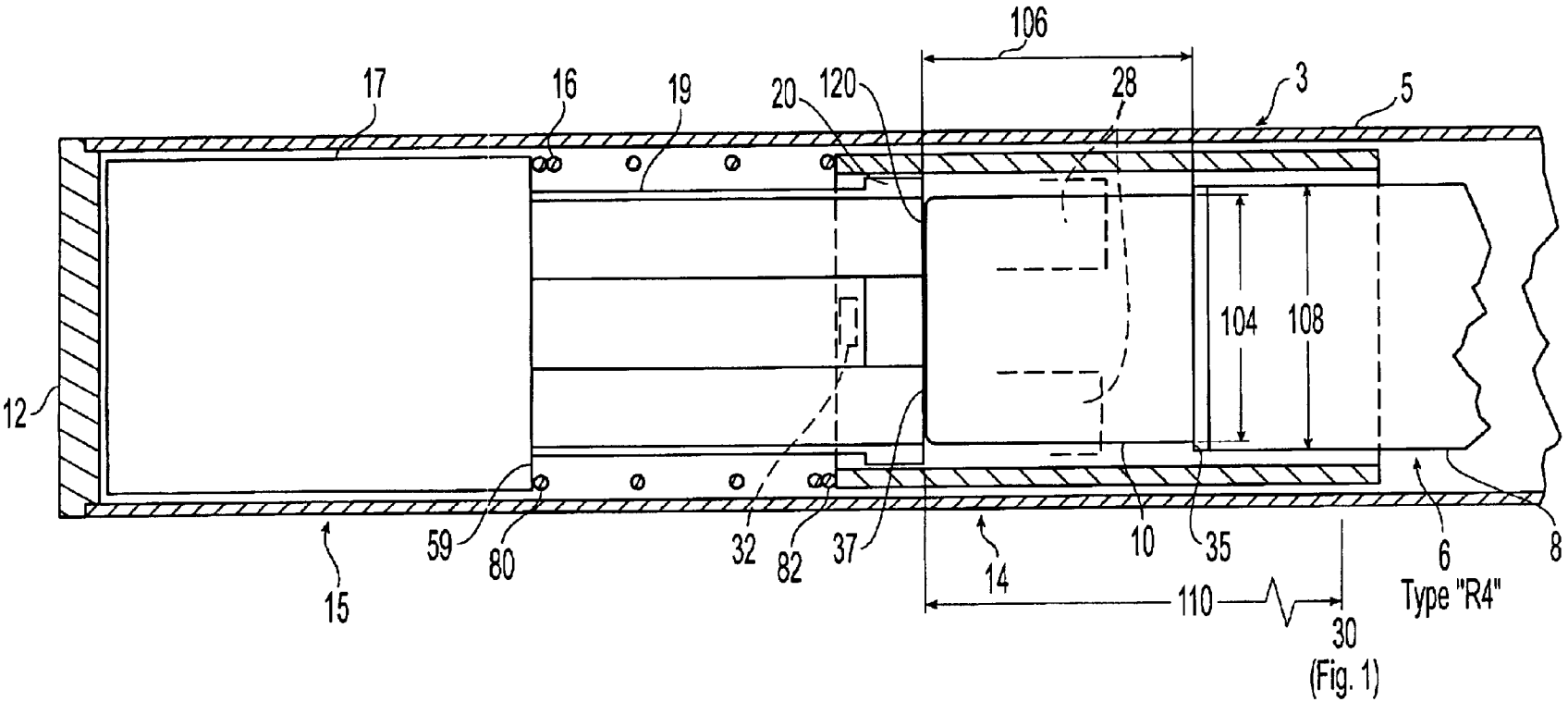
FIG. 13 is a partial cross-sectional enlarged view of part of the upper portion of a writing instrument having a refill seat mechanism with a rod having a plain end and the sleeve is in a sleeve forward position.

In another embodiment, FIG. 13 shows a portion of a writing instrument 1 having a refill seat mechanism formed in accordance with the principles of the present invention, but wherein seat 24 has been entirely omitted. As shown in FIG. 13, and similar to other embodiments previously described herein, refill seat mechanism 2 has a rod 15, and a sleeve 14 that is operably engaged by rod 15. Free end 37 of rod 15, however, need not necessarily have angled surfaces 22 (shown in FIG. 2), and free end 37 defines a seating surface 120 to operably engage a refill. Preferably, free end 37 is substantially flat, as shown; however, other end configurations are suitable as well. To achieve a first chamber length, a type "R4" refill (as shown) is used whose end plugs 10 and seating ends 8 are sized to operably engage seating surface 120, but not engage sleeve 14. Refill type "R4" operably engages and contacts seating surface 120 when refill "R4" is inserted into writing instrument housing 2, and lower and upper housing portions 4, 5 are subsequently coupled together. Sleeve 14 remains in the "sleeve forward" position.

Figure 14:
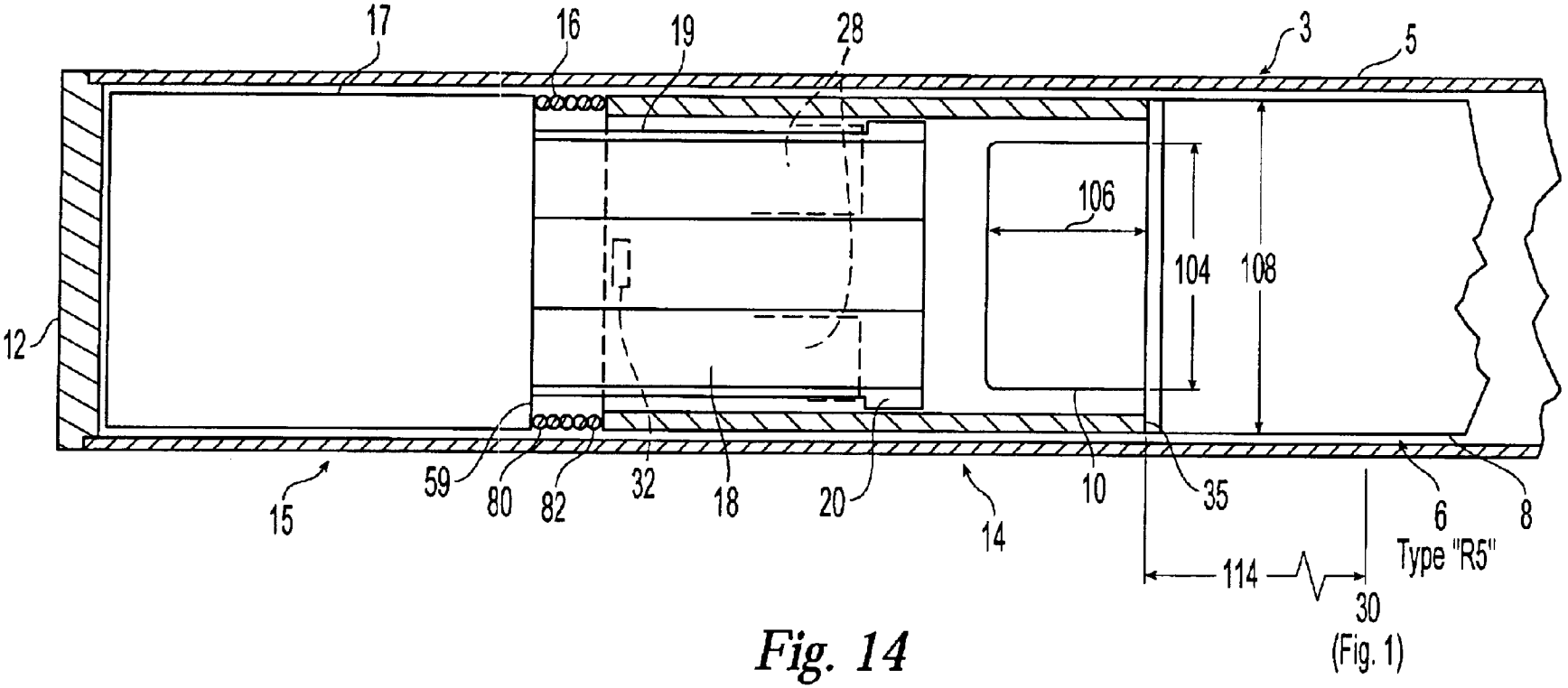
FIG. 14 is a partial cross-sectional enlarged view of part of the upper portion of a writing instrument having a refill seat mechanism with a rod having a plain end and the sleeve is in a sleeve back position.

FIG. 14 shows the same refill mechanism of FIG. 13, but used with a type "R5" refill (described above) which is adapted and configured to engage sleeve 14 without engaging seating surface 120. A refill type "R5" may be provided with an end plug 10 which projects from the end of refill type "R5" (as shown) or with a flat end plug 10 (as shown in FIG. 11) which does not project. If a projecting type end plug 10 is used as shown in FIG. 14, in one embodiment, length 106 of end plug 10 may be sized short enough to avoid contact with engaging seating surface 120 when sleeve 14 fully compresses biasing member 16 against ledge 59 of rod 15 (as shown), or to avoid contact when biasing member 16 is only partially compressed in a continuum of variable positions of sleeve 14 as previously described herein with reference to FIGS. 11 and 12. In another embodiment, the length 106 of end plug 10 may be sized to just come into contact with engaging seating surface 120 when sleeve 14 fully compresses biasing member 16 against ledge 59 of rod 15.

With continuing reference to FIG. 14, a second chamber length is achieved by inserting a type "R5" refill into writing instrument housing 2, and coupling lower and upper housing portions 4, 5 together. In the embodiment shown, sleeve 14 is pushed axially back towards rod 15 until biasing member 16 is fully compressed against ledge 59 of rod 15 to bring sleeve 14 to the "sleeve back maximum" position described heretofore. Accordingly, a second chamber length is created to accommodate refill type "R5" which is shorter than refill type "R4."

It will be appreciated that in the refill seat mechanism embodiments shown in FIGS. 13 and 14, opening 21 in rod 15 (see, e.g., FIGS. 2, 9, 10, etc.) may be omitted. Unlike other embodiments described previously herein, opening 21 is not necessarily needed because seat 24 has been omitted from the embodiments shown in FIGS. 13 and 14. As shown in FIGS. 13 and 14, splines 28 of sleeve 14 do not necessarily require angled ends 31.

Figure 15:
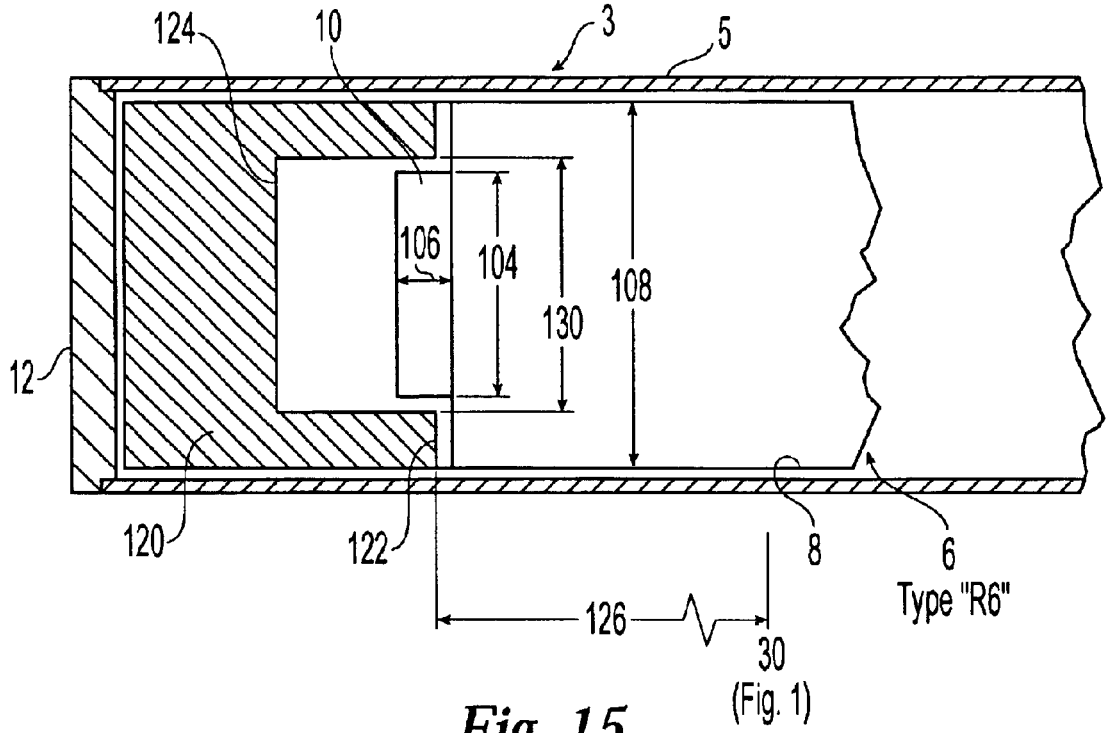
FIG. 15 is a partial cross-sectional enlarged view of part of the upper portion of a writing instrument having a refill seat mechanism in accordance with the principles of the present invention having a seating element and shown with one type of refill.
Figure 16:
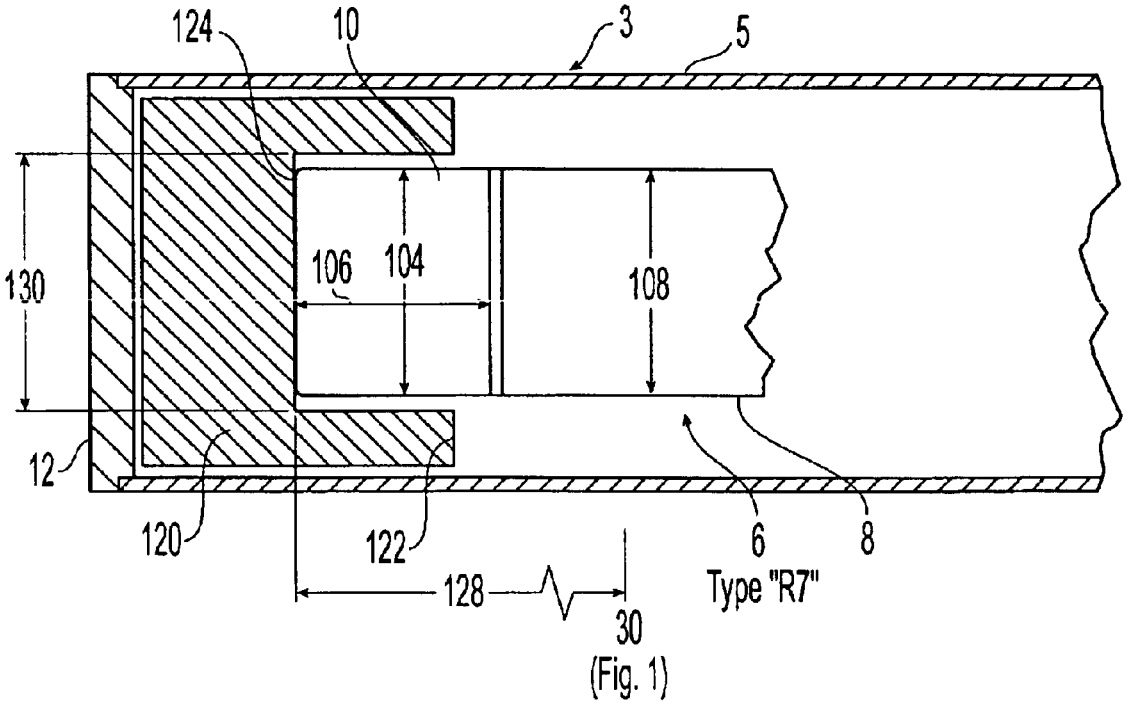
FIG. 16 is a partial cross-sectional enlarged view of part of the upper portion of a writing instrument having a refill seat mechanism of FIG. 15, but shown with another type of refill.

Another embodiment of an automatically-adjusting refill seat mechanism is shown in FIGS. 15 and 16. The refill seat mechanism comprises a seating element 120 having a first seating surface 122 and a second seating surface 124. First seating surface 122 is associated with a first chamber length 126 formed by using a type "R6" refill as shown in FIG. 15. Second seating surface 124 is associated with a second chamber length 128 formed by using a type "R7" refill as shown in FIG. 16. In the embodiments shown in FIGS. 15 and 16, seating end 8 of a type "R6" refill has a larger outside diameter 108 than the seating end 8 of a type "R7." In addition, outside diameter 104 of end plug 10 of a type "R6" refill is preferably larger than the inside diameter 130 of seating element 120. This allows end plug 10 of a type "R6" refill to engage first seating surface 122 without necessarily engaging second seating surface 124 as shown in FIG. 15, thereby creating first chamber length 126. By contrast, outside diameter 104 of end plug 10 of a type "R7" refill is preferably smaller than the inside diameter 130 of seating element 120. This allows end plug 10 of a type "R7" refill to engage second seating surface 124 without engaging first seating surface 122 as shown in FIG. 16, thereby creating second chamber length 128. In general, it will be appreciated that a type "R6" refill may be shorter and wider in diameter 108 than a type "R7" refill which may be longer and narrower.

It should be noted that seating element 120 shown in FIGS. 15 and 16 may be a separate component attached or secured to the inside of upper portion 5 of writing instrument housing 3 (e.g., by adhesive, threadably fastened, friction or shrink fit, etc.), or seating element 120 may be an integral part of upper portion 5 of housing 3 (not shown). In addition, seating element 120 may itself be comprised of a separate first seating surface 122 and second seating surface 124 which are assembled together using any conventional method typical in the art. Although seating element 120 as shown in FIGS. 15 and 16 preferably has two seating surfaces as shown, it will be appreciated that more than two seating surfaces may be provided forming more than two different chamber lengths, depending on the dimensions of the various refills to be usable in the writing instrument.

Although the automatically-adjusting refill seat mechanism of the present invention has been illustrated in the foregoing description through writing instrument embodiments of the non-retractable type; the refill seat mechanism may be used in capless retractable-type instrument applications as well whose application will be readily apparent to those skilled in the art. Accordingly, refill seat mechanism 2 may be embodied in a retractable-type writing instrument having a conventional spring-loaded push-button refill retraction mechanism, a turn-knob or barrel-twist rotary refill retraction mechanism, or any other suitable refill retraction means. When used in retractable-type writing instruments, the relative position of the entire refill seat mechanism 2 is merely shifted in relation to the writing instrument housing to either extend the refill from the instrument housing for writing, or to retract the refill for storage. Thus, as with non-retractable type writing instruments described herein, the proper chamber length for the type of refill selected (i.e., refill types "R1," "R2," "R3," "R4," "R5," "R6," and "R7") is still automatically created in accordance with principles of the present invention when the writing instrument housing is uncoupled, the selected refill of choice is inserted, and the housing is recoupled.

It should be noted that in the case of spring-loaded push-button type refill retraction mechanisms, the spring used in the retraction mechanism serves a different purpose and is separate from biasing member 16 of the present refill seat mechanism invention (see, e.g., FIG. 1). Moreover, the retraction spring is typically located in the lower portion 4 of the writing instrument housing 3 near the refill cartridge writing end 7 (retraction spring not shown in FIG. 1), and not in the upper housing 5 as shown in FIG. 1.

The automatically-adjusting refill mechanism may be used with a writing instrument having a housing fabricated of any type material (e.g., plastic, metal, a combination thereof, etc.), and the invention is not limited in this regard to its applicability.

It will also be appreciated by those skilled in the art that the details of the refill seat mechanism described herein are matter of design choice, and the invention is not limited to the particular embodiments described herein. Accordingly, numerous modifications and variations may be made to the refill seat mechanism without departing from the spirit of the invention and scope of the claims appended hereto.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. An automatically-adjusting refill seat mechanism for a writing instrument, said mechanism comprising:

a first element having a first seating surface configured and adapted to engage a first seating end of a first type of refill having a first length, said first element configured and sized to fit in a writing instrument having an internal chamber for containing refills, said first element having a longitudinal axis;

a second element having a second seating surface configured and adapted to engage a seating end of a second type of refill having a second length, said second element axially movable with respect to said first element from a first position to a second position, said second element configured and adapted to allow the first seating end of the first type of refill to be inserted therethrough for contacting said first seating surface;

wherein:

inserting the first type of refill in the writing instrument engages said first seating surface defining a first refill chamber length; and inserting the second type of refill in the writing instrument engages at least said second seating surface and automatically moves said second element from said first position to said second position defining a second refill chamber length.

2. The refill seat mechanism of claim 1, wherein said first element is a rod and said second element is a hollow sleeve movable over at least a portion of said first element.

3. The refill seat mechanism of claim 1, further comprising a biasing member interposed between at least part of said first element and at least part of said second element to bias said second element into said first position of said second seating surface.

4. The refill seat mechanism of claim 1, wherein said second chamber length is greater than said first chamber length.

5. The refill seat mechanism of claim 1, wherein:

said first element has a head;

said refill seat mechanism further comprises a rod operably engaged with said head;

said head is axially movable with respect to said rod from a first position to a second position; and when said head is engaged by a seating end of a third type of refill having a third length and configured to engage said second element, said head automatically moves from said first position to said second position defining a third chamber length.

6. The refill seat mechanism of claim 5, further comprising a biasing member interposed between at least part of said second element and at least part of said rod to bias said second element into said first position of said second element.

7. The refill seat mechanism of claim 5, wherein:

said rod is elongated and has first and second ends and an axial opening extending at least partially into one of said ends;

a stem projects from said head; and said stem is slidably engaged in said axial opening.

8. The refill seat mechanism of claim 7, wherein:

said rod has angular surfaces facing said head and said head has mating angular surfaces facing said rod angular surfaces;

said angular surfaces of said rod and head are unmeshed when said head is in said first position of said head; and said angular surfaces of said rod and head are meshed when said head is in said second position of said head.

9. An automatically-adjusting refill seat mechanism for a writing instrument, said refill seat mechanism comprising:

a rod configured and adapted to fit in a writing instrument, said rod having an outside surface, a first end with angled surfaces, and a second end;

a hollow sleeve configured and adapted to fit in and to slide within the writing instrument, said sleeve slidably engaging at least a portion of said rod and having an inside surface;

a biasing member interposed between at least a portion of said rod and at least a portion of said sleeve; and a seat movably disposed inside said sleeve and having a head and a stem, said head having angled surfaces cooperatively configured and adapted to engage said angled surfaces of said rod;

wherein said seat is automatically movable from a first position in which said angled surfaces of said rod and said seat are prevented from meshing, thereby defining a first chamber length for a first refill in said writing instrument, to a second position in which said angled surfaces of said rod and said seat mesh, thereby defining a second chamber length for a second refill in the writing instrument.

10. The refill seat mechanism of claim 9, wherein said rod has raised ears extending radially outwardly from said outside surface and said sleeve has splines extending radially inward from said inside surface, said splines defining channels for slidably engaging said ears.

11. The refill seat mechanism of claim 10, wherein said rod has raised rails extending radially outwardly from said outside surface and longitudinally aligned with said raised ears.

12. The refill seat mechanism of claim 11, wherein said seat has raised tabs extending radially outwardly and sized to be slidably engaged in said channels.

13. The refill seat mechanism of claim 12, wherein at least part of said raised tabs have angled sides and said splines have angled ends.

14. The refill seat mechanism of claim 9, wherein said rod has an opening therein configured and adapted to receive at least part of said stem of said seat.

15. The refill seat mechanism of claim 9, wherein said biasing member is a helical spring.

16. The refill seat mechanism of claim 9, wherein:

said head has a seating surface configured for abutment with an end of a refill such that the refill can effect automatic adjustment of said refill mechanism upon contacting and pushing said seating surface; and the refill is movable out of abutment with said seating surface to permit another refill to abut said seating surface.

17. A writing instrument having a variable length refill chamber comprising:

a housing defining an elongated internal chamber having a length to hold a refill cartridge, said housing having a lower portion and an upper portion coupled together;

an automatically-adjusting refill seat mechanism disposed in said housing, said refill seat mechanism comprising:

a first element having a first seating surface configured and adapted to engage a first seating end of a first type of refill having a first length, said first element configured and sized to fit in a writing instrument having an internal chamber for containing refills, said first element having a longitudinal axis;

a second element having a second seating surface configured and adapted to engage a seating end of a second type of refill having a second length, said second element axially movable with respect to said first element from a first position to a second position, said second element configured and adapted to allow the first seating end of the first type of refill to be inserted therethrough for contacting said first seating surface;

wherein:

inserting the first type of refill in the writing instrument engages said first seating surface defining a first refill chamber length; and inserting the second type of refill in the writing instrument engages at least said second seating surface and automatically moves said second element from said first position to said second position defining a second refill chamber length.

18. The writing instrument of claim 17, further comprising a biasing member is interposed between at least a portion of said first element and at least a portion of said second element.

19. A writing instrument comprising:

a housing having upper and lower portions defining an elongated chamber therein for containing a refill cartridge having one of at least two different lengths, a writing end, and an opposite seating end, said elongated chamber having a length;

a first seating element configured and adapted for selectively engaging the seating end of a refill cartridge upon insertion of the refill cartridge in said housing; and a second seating element configured and adapted for selectively engaging the seating end of a refill cartridge upon insertion of said refill cartridge in said housing, said first and second seating elements slidably with engaging each other, both said seating elements being disposed elongated chamber of said housing;

wherein said first and second seating elements are movable with upon engagement by a refill cartridge upon insertion of the refill cartridge in said housing to adjust the length of said housing chamber automatically to correspond to one of the refill cartridge lengths such that the refill is held in a proper position for writing.

20. The writing instrument of claim 19, wherein said upper portion of said housing is closed, thereby enclosing said first and second seating elements such that movement of said first and second seating elements is effected solely from within said elongated chamber in the housing.

21. A method for using refills of different lengths in a refillable writing instrument, said method comprising:

providing a writing instrument having a housing defining an elongated internal chamber, the housing and chamber each having a length, the housing having a lower portion and an upper portion coupled together;

providing an automatically-adjusting refill seat mechanism in the chamber, the mechanism comprising:

a first seating element configured and adapted for selectively engaging the seating end of a refill cartridge upon insertion of the refill cartridge in the housing;

a second seating element configured and adapted for selectively engaging the seating end of a refill cartridge upon insertion of the refill cartridge in the housing said the first and second seating elements being slidably engaged with each other;

uncoupling the lower and upper portions of the housing;

inserting a refill having a length into the chamber; and recoupling the lower portion and the upper portions of the housing;

whereupon the refill engages at least one of the first and second seating elements and the first and second seating elements are movable with respect to each other to automatically adjust the chamber length to hold the refill in a proper position for writing without requiring manual adjustment of the housing or chamber lengths or the relative positions of the seating elements.

22. The method of claim 21, wherein the seating elements are enclosed in a closed end of the housing such that movement of either seating element is effected solely from within the chamber in the housing by said inserting of a refill into the chamber.

23. A writing instrument for containing refills of different lengths, said writing instrument comprising:

a housing having an internal chamber therein for containing a refill having a writing end and an opposite seating end;

a first seating element having a first surface for selectively contacting the seating end of a first type of refill; and a second seating element having a second surface for selectively contacting the seating end of a second type of refill, said second seating element operably engaged with the first seating element and automatically axially movable with respect thereto upon contact by the refill, the first and second seating elements being disposed in the internal chamber of the housing;

wherein the movability of said second seating element with respect to said first seating element enables refills of different lengths to be used and properly positioned in said writing instrument for writing automatically without manual adjustment of said internal chamber.

24. The writing instrument of claim 23, wherein:

said housing has an open distal writing end through which the writing end of a refill end is extendable and a closed proximal non-writing end closing off said internal chamber;

said first and second seating elements are positioned within said closed end of said housing; and said second seating element is moved by contact by the refill within said internal chamber.

25. An automatically-adjusting refill seat mechanism for a writing instrument, said refill seat mechanism comprising:

a rod configured and adapted to fit in a writing instrument, said rod having chamber positioning and sleeve-receiving portions;

a sleeve configured and adapted to fit in the writing instrument for slidable movement therein, said sleeve slidably engaging at least a portion of said sleeve-receiving portion of said rod and slidable upon contact with a refill of a given length and configuration;

a seat disposed in said sleeve and engageable with said sleeve-receiving portion of said rod, said seat moveable from a first position to a second position;

wherein said rod, sleeve, and seat are arranged and configured such that contact with a refill automatically adjusts the position of said seat with respect to said rod.

26. A writing instrument automatically adaptable to accommodating refills of different lengths, said writing instrument comprising:

a housing having an internal chamber for containing a writing instrument refill having a writing end and an opposite seating end, said housing having a length, an open writing end at one end of the length through which a writing end of a refill extends, and a closed end at the other end of the length closing said internal chamber from access from outside said housing;

a first seating surface disposed in said housing along said length of said housing, said first seating surface configured and adapted to engage a seating end of a first type of refill having a first length, said first seating surface being located at a first position along said length of said housing when the first type of refill is inserted in said housing, said first position being associated with a first chamber length; and a second seating surface disposed in said housing along said length of said housing, said second seating surface configured and adapted to engage a seating end of a second type of refill having a second length which is different from the first length, said second seating surface being located at a second position along said length of said housing which is different from said first position when the second type of refill is inserted in said housing, said second position being associated with a second chamber length which is different from said first chamber length;

wherein said writing instrument automatically provides a proper seating surface position and chamber length for a writing end of either the first or second type of refill to extend out the writing end of the housing upon insertion of the refill in said housing without manual adjustment of said first or second seating surfaces.

27. The writing instrument of claim 26, wherein said first seating surface is annular in shape and raised above said second seating surface.

28. The writing instrument of claim 23, wherein said first and second seating surfaces are configured such that the first seating end of the first type of refill may engage said first seating surface without engaging said second seating surface.

29. The writing instrument of claim 26, wherein seating surface and said second seating surface form a cup-shaped refill seat of unitary structure.

30. The writing instrument of claim 26, wherein said first and second seating surfaces are not accessible from outside said internal chamber for manual adjustment.

* * * * *

UNITED STATES PATENT AND TRADEMARK OFFICE

CERTIFICATE OF CORRECTION

PATENT NO. : 6,764,240 B2
DATED : July 20, 2004
INVENTOR(S) : Ryan S. Eddington

It is certified that error appears in the above-identified patent and that said Letters Patent is hereby corrected as shown below:

Column 20,
Line 1, after "slidably" please delete "with";
Line 5, "after "able" please delete "with";
Line 29, please replace "housing said" with -- housing, --;

Column 22,
Line 27, please replace "claim 23" with -- claim 26 --.
Line 32, after "wherein" please insert -- said first --.

Signed and Sealed this

Eighth Day of February, 2005

JON W. DUDAS
*Director of the United States Patent and Trademark Office*